United States Patent [19]

Aslan

[11] Patent Number: 4,616,753

[45] Date of Patent: Oct. 14, 1986

[54] PEGBOARD HANGERS

[75] Inventor: Ozay Aslan, Brampton, Canada

[73] Assignee: Cochrane-Dunlop Limited, Etobicoke, Canada

[21] Appl. No.: 787,187

[22] Filed: Oct. 15, 1985

[51] Int. Cl.[4] ..... A47F 7/00

[52] U.S. Cl. ..... 211/57.1; 248/220.4

[58] Field of Search ..... 211/57.1, 59.1, 54.1; 248/220.3, 220.4, 221.2, 222.2

[56] References Cited

U.S. PATENT DOCUMENTS

| | | | |
|---|---|---|---|
| 1,732,162 | 10/1929 | Griner | 248/222.2 X |
| 3,226,072 | 12/1965 | Johnson | 248/221.1 |
| 3,696,937 | 10/1972 | Braverman | 248/220.4 |

FOREIGN PATENT DOCUMENTS 2644336 12/1977 Fed. Rep. of Germany .

*Primary Examiner*—Ramon S. Britts
*Assistant Examiner*—Sarah A. Lechok
*Attorney, Agent, or Firm*—Arne I. Fors; Robert Delbridge

[57] ABSTRACT

An apparatus for supporting and displaying merchandise on a peg board storage unit is disclosed. The apparatus has a plurality of bracket rods adapted at one end to be removably attached to the peg board and adapted at the opposite distal end to receive packages and cards by insertion of the rods into holes formed in said packages and cards. The bracket rods are laterally horizontally displaced at a region intermediate the ends thereof a distance substantially equal to the horizontal spacing of vertical rows of holes on the peg board whereby packages on said rods in the next vertical row are aligned with packages in a first vertical row for improved inventory storage and display and for enhanced inventory control.

2 Claims, 3 Drawing Figures

PEGBOARD HANGERS

BACKGROUND OF THE INVENTION

This invention relates to an apparatus for supporting and displaying merchandise and, more particularly, relates to an apparatus for improved display and inventory control of merchandise on peg boards.

Apparatuses for display of an inventory of merchandise in packages or on cards are well known. Canadian Pat. No. 1060847 issued Aug. 21, 1979 discloses an inventory control merchandise display apparatus in which bracket rods extending from a peg board have flattened regions at intervals along the length of the rods for attachment of labels, the distal end of the rods being obliquely inclined laterally and upwardly to visibly support a label.

U.S. Pat. No. 4217986 issued Aug. 19, 1980 shows a restraining device for attachment to rods of display brackets for placement control of inventory on the rods.

U.S. Pat. No. 3696937 issued Oct. 10, 1972 discloses a hanger bracket having an outwardly extending finger provided with a plurality of elongated, generally longitudinal steps for varying the levels of cards contained on the bracket for visual control of inventory.

The foregoing patents are all directed to inventory control for visible ascertaining of stock requirements and for displaying inventory to purchasers. The present invention is directed to a package display apparatus which permits vertical alignment of packages at different heights for optimum inventory capacity and improved display of products to customers.

SUMMARY OF THE INVENTION

In its broad aspect, the package-display apparatus of the present invention comprises a base having a plurality of holes arranged in equispaced horizontal and vertical rows, commonly known as peg board, a merchandise-supporting bracket rod having mounting means at one end for attaching said rod to the base, said rod having a distal end extending in a direction away from the base, said rod being laterally, horizontally offset intermediate the mounting means at one end and the distal end whereby merchandise supported on said offset portion of the rod is laterally displaced a distance substantially equal to a multiple of, i.e. at least one of, the horizontal spacing of vertical rows of holes.

More particularly, the apparatus of the present invention comprises a plurality of vertically-aligned bracket rods adapted to be mounted on said base, the uppermost rod being linear and mounted in a first pair of vertical rows of holes and each descending rod being mounted in a vertical row of holes laterally offset at least one row of holes from the first pair of vertical rows of holes, said descending rods in succession having a lateral, horizontal offset portion progressively more distant from the base whereby merchandise supported on said rods on the horizontally offset portion are vertically aligned in horizontal rows more distant from the base at progressively lower levels.

It is a principal object of the present invention to provide a hanger bracket and an apparatus incorporating said hanger bracket with a peg board base for improved storage of inventory and for enhanced customer display of inventory products suspended on the brackets.

Another object of the present invention is the provision of a hanger bracket apparatus which provides a simple visual inventory control for locating products on a desired portion of the bracket rod, thereby allowing optimum display of the products and ease of determining quantities of products to be reordered.

BRIEF DESCRIPTION OF THE DRAWINGS

The manner in which these and other objects of the invention can be attained will become apparent from the following detailed description of the invention, in which.

DESCRIPTION OF THE PREFERRED EMBODIMENT

Figure 1:
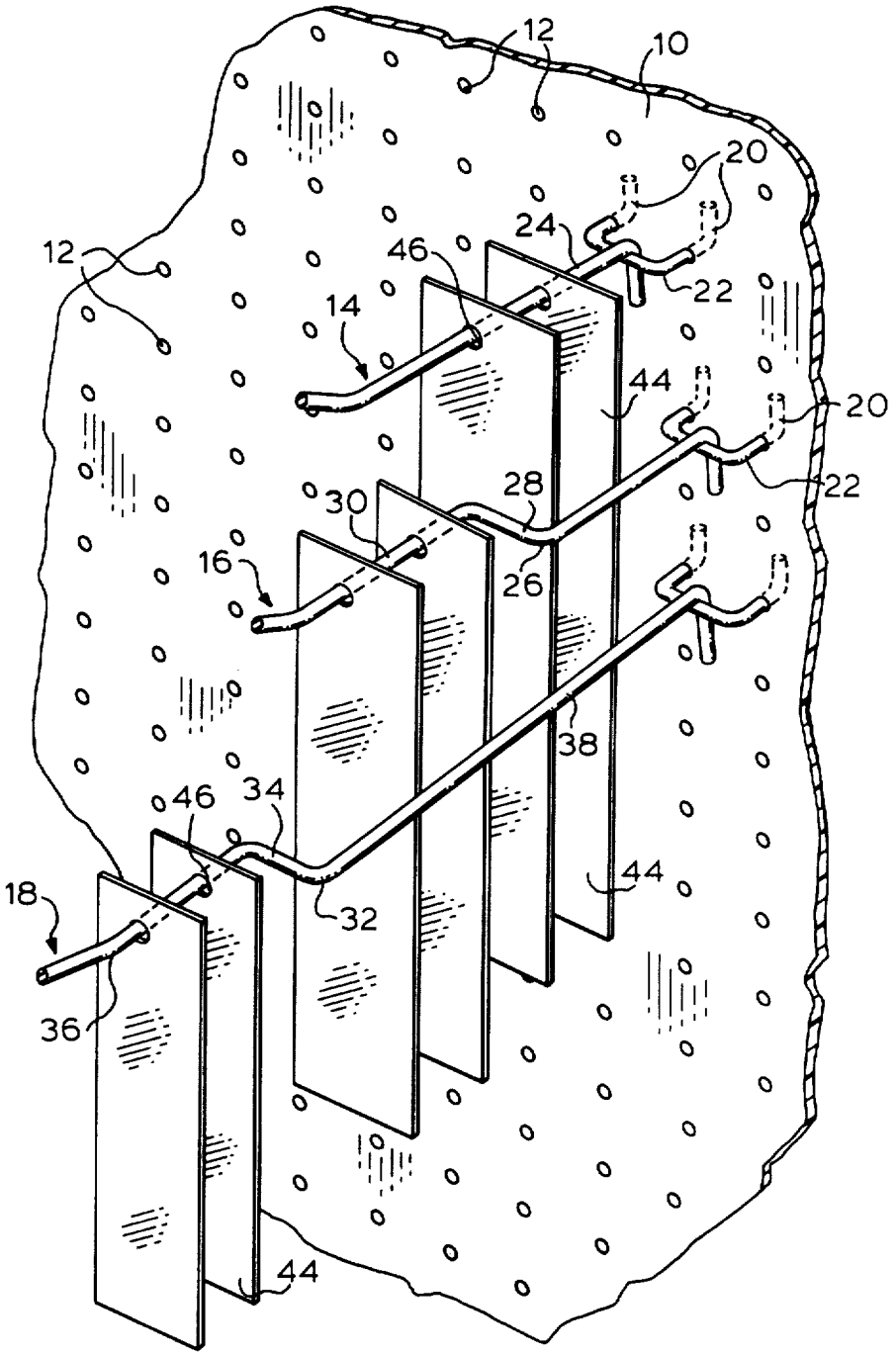
FIG. 1 is a perspective view of the apparatus of the present invention in its operative position displaying a product inventory.
Figure 2:
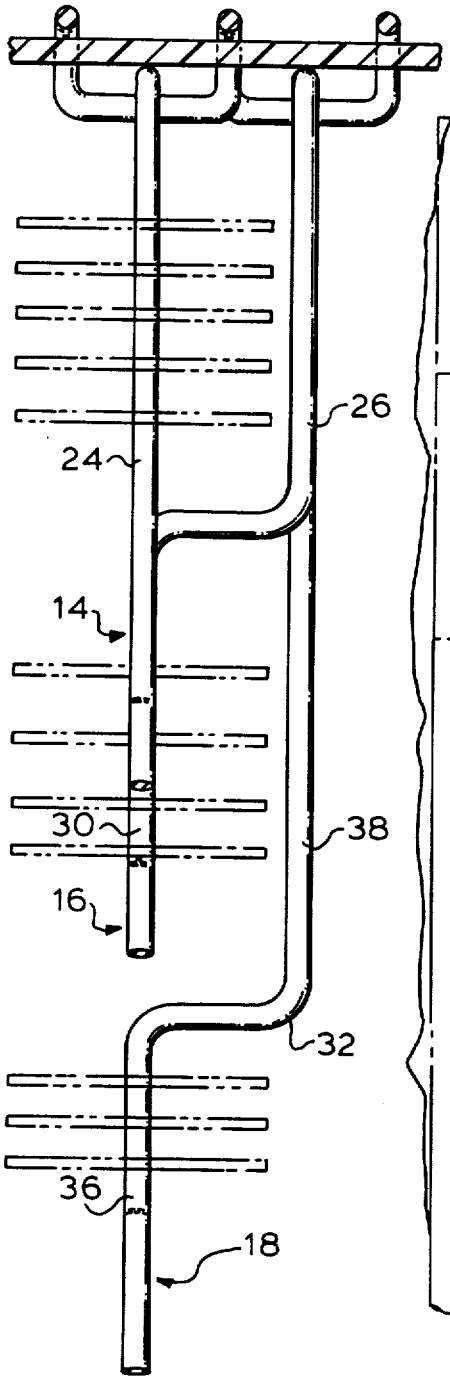
FIG. 2 is a plan view, from above, illustrating the apparatus of the invention typified in FIG. 1; and, FIG. 3 is a front elevation of the apparatus of the invention.
Figure 3:
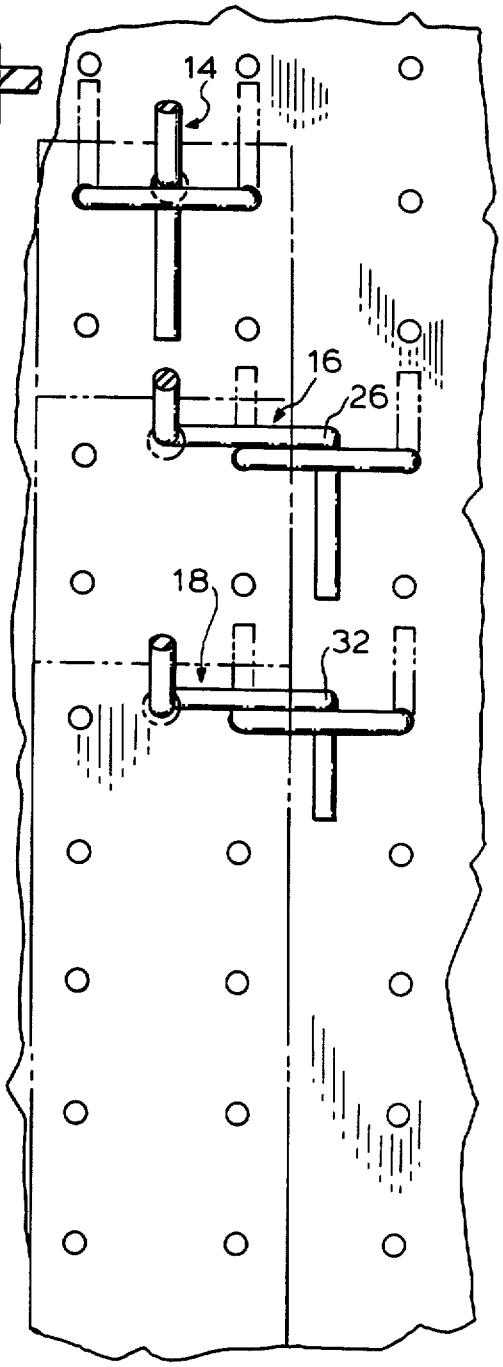

In accordance with the preferred embodiment of the invention, base 10 is a conventional peg board having uniformly spaced vertical and horizontal rows of holes 12. Base 10 is adapted to receive bracket rods typified by bracket rods 14, 16 and 18 removably mounted in vertical pairs of holes 12 by means of a pair of laterally-spaced arms or prongs 20 forming part of U-shaped web 22, well known in the art. Prongs 20 are upwardly bent to abut the rear surface of base 10 to support, in cantilever fashion, rod 24, for example, of bracket rod 14.

Upper bracket rod 14 of the apparatus of the present invention normally is linear, which is common to known hanger bracket systems. The next lower bracket 16 with conventional mounting means is laterally, horizontally bent and offset at a region 26 intermediate its ends by lateral portion 28 which has a length substantially equal to the horizontal spacing of holes 12 such that the distal rod end 30 is in substantial vertical alignment with rod 24 of uppermost bracket rod 14.

The next lower bracket rod 18 is laterally bent in the region indicated at 32 to provide offset portion 34 having a length again substantially equal to the horizontal spacing of holes 12 such that the distal rod end 36 is in substantial vertical alignment with rod 24 and the distal end of rod 30. The inner portion 38 of bracket rod 18 is substantially equal in length to the total length of bracket rod 16 such that products supported by the distal end 36 on bracket rod 18 are lower than and forwardly of the products supported on the distal end 30 of bracket rod 16.

Commencing with upper bracket rods 14, each successively lower bracket rod as typified by bracket rods 16 and 18 is progressively longer with the horizontal, laterally bent portion located substantially below the terminus of the distal end of the adjacent bracket rod. Merchandise in the form of packages and cards 44 mounted on the rods by insertion of the rods through holes 46 formed therein are automatically positioned on the laterally offset distal portions of the rods at different levels in vertical alignment such that merchandise on progressively lower rods are more distal from the base and in front of merchandise on the upper rods. Display of the merchandise to customers is enhanced and compactness of storage of an inventory of products is improved. In addition, inventory control by visual inspection of the rows of merchandise is facilitated.

Although lateral offset portions 28, 34 are substantially equal in length to the horizontal spacing of one row of holes from a first pair of vertical rows of holes, it will be understood that the horizontal spacing may be multiples of the horizontal spacing of vertical rows of holes, i.e. one or more multiples of said horizontal spacing, to accommodate the width of packages and cards 44 supported on the distal portions of said rods in vertical alignment with the uppermost bracket rod 14.

It will be understood, of course, that modifications can be made in the embodiment of the invention illustrated and described herein without departing from the scope and purview of the invention as defined by the appended claims.

What I claim as new and desire to protect by Letters Patent of the United States is:

1. A package-display apparatus comprising a base having a plurality of holes arranged in equispaced horizontal and vertical rows, a plurality of vertically-aligned bracket rods having mounting means at one end for attaching said rods to the base, said rods each having a distal end extending in a direction away from the base, the uppermost rod of said plurality of rods being linear and mounted in a first pair of vertical rows of holes, each successively lower bracket rod beinq mounted in a pair of vertical rows of holes laterally offset at least one row of holes from said first pair of vertical rows of holes, said successively lower rods having lateral, horizontally offset portions formed in the distal ends progressively more distant from the base whereby merchandise supported on said rods on the horizontally offset distal portions thereof are vertically aligned in horizontal rows more distant from the base at progressively lower levels.

2. A package-display apparatus as claimed in claim 1 wherein said lateral, horizontal offset portion on each successively lower bracket rod is substantially below the terminus of the distal end of the bracket rod next thereabove.

* * * * *